US009677803B2

(12) United States Patent
Bauriedl et al.

(10) Patent No.: US 9,677,803 B2
(45) **Date of Patent: *Jun. 13, 2017**

(54) ICE DISPENSING ARRANGEMENT

(71) Applicants: BSH HAUSGERAETE GMBH, Munich (DE); EMZ-HANAUER GMBH & CO. KGAA, Nabburg (DE)

(72) Inventors: Josef Bauriedl, Neunburg V.W. (DE); Albert Dirnberger, Neunburg V.W. (DE)

(73) Assignees: BSH Hausgeraete GmbH, Munich (DE); EMZ-Hanauer GmbH & Co. KGAA, Nabburg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/653,296

(22) PCT Filed: Dec. 16, 2013

(86) PCT No.: PCT/EP2013/076741

§ 371 (c)(1),
(2) Date: Jun. 18, 2015

(87) PCT Pub. No.: WO2014/095748

PCT Pub. Date: Jun. 26, 2014

(65) Prior Publication Data

US 2015/0338147 A1 Nov. 26, 2015

(30) Foreign Application Priority Data

Dec. 18, 2012 (DE) ..... 10 2012 223 625

(51) Int. Cl.

| | |
|---|---|
| ***F25C 5/00*** | (2006.01) |
| ***E05F 15/611*** | (2015.01) |
| ***F25C 5/04*** | (2006.01) |

(52) U.S. Cl.
CPC ..... *F25C 5/005* (2013.01); *E05F 15/611* (2015.01); *F25C 5/046* (2013.01);
(Continued)

(58) Field of Classification Search
CPC ..... F25C 5/005; F25C 5/046; F25C 2400/08; F25C 2400/10; E05F 15/611; E05Y 2900/31; E05Y 2201/434
See application file for complete search history.

(56) References Cited

U.S. PATENT DOCUMENTS 3,889,888 A 6/1975 Prada
4,176,527 A * 12/1979 Linstromberg ..... F25C 5/046 222/240

(Continued)

FOREIGN PATENT DOCUMENTS

DE 102011006249 A1 10/2012
WO 2009078620 A2 6/2009

*Primary Examiner* — Frederick C Nicolas
(74) *Attorney, Agent, or Firm* — Laurence A. Greenberg; Werner H. Stemer; Ralph E. Locher

(57) ABSTRACT

An ice dispensing arrangement is particularly suited for a household refrigeration appliance. A flap can rotate between a first and a second distribution position. A motor actuates the flap via a transfer device. The transfer device has a rotating transfer element and a flap actuating device. The rotating transfer element is rotated between a first and a second position, in order to rotate the flap, by way of the flap actuation device, between the first and second distribution positions. The rotating transfer element is coupled to the flap actuation device so that the flap, in the first position of the rotating transfer element, is arranged in the first distribution position and, in the second position of the rotating transfer element, the flap is arranged in the second distribution position. A blocking device maintains the flap in the first distribution position.

13 Claims, 6 Drawing Sheets

(52) U.S. Cl.
CPC ..... *E05Y 2201/434* (2013.01); *E05Y 2900/31* (2013.01); *F25C 2400/08* (2013.01)

(56) References Cited

U.S. PATENT DOCUMENTS

| | | | | |
|---|---|---|---|---|
| 6,880,355 | B2 | 4/2005 | Jung | |
| 8,899,064 | B2 | 12/2014 | Hwang | |
| 2006/0144976 | A1 | 7/2006 | Lee et al. | |
| 2015/0300718 | A1* | 10/2015 | Bauriedl | F25C 5/005 222/173 |

* cited by examiner

ICE DISPENSING ARRANGEMENT

BACKGROUND OF THE INVENTION

Field of the Invention

The invention relates to an ice dispensing arrangement, in particular for a household refrigeration appliance, which comprises a flap which can be pivoted between a first dispensing position and a second dispensing position, a transfer device and a motor, which actuates the flap by way of the transfer device.

Flaps are used for the dispensing of ice from an ice storage container. Such a flap mechanism is frequently actuated by way of lifting magnets, with the flap being reset by springs. Alternatively in U.S. Pat. No. 6,880,355 B2 a cam disk solution is described, which activates the flap for dispensing from the ice storage container by means of a motor and a cam disk.

BRIEF SUMMARY OF THE INVENTION

It is the object of the invention to specify an improved ice dispensing arrangement and an improved household refrigeration appliance.

The object is achieved by the subject matter of matter of the claims.

Advantageous embodiments of the ice dispensing arrangement are the subject matter of the dependent claims.

According to the invention an ice dispensing arrangement, in particular for a household refrigeration appliance, comprises a flap, which can be pivoted between a first dispensing position and a second dispensing position, a transfer device and a motor, which actuates the flap by way of the transfer device. The transfer device has a rotating transfer element and a flap actuation device, it being possible to rotate the rotating transfer element between a first position and a second position in order to pivot the flap between the first dispensing position and the second dispensing position by means of the flap actuation device. The rotating transfer element is coupled to the flap actuation device in such a manner that the flap is in the first dispensing position when the rotating transfer element is in the first position and the flap is in the second dispensing position when the rotating transfer element is in the second position. A blocking device is provided to hold the flap in the first dispensing position.

A household refrigeration appliance refers to a refrigeration appliance, in other words a refrigeration appliance, which is used for household management in domestic situations or possibly also in the catering sector, and serves in particular to store food and/or beverages in normal domestic quantities at defined temperatures, for example a refrigerator, a freezer cabinet, a combined fridge/freezer, a chest freezer or a wine storage cabinet.

In refrigeration appliances, in particular in household refrigeration appliances, an apparatus is frequently provided for producing ice cubes. An ice maker (an apparatus for supplying ice cubes), an ice crusher (an apparatus for crushing ice cubes) and a dispenser for the removal of the ice cubes can be provided for this purpose. The ice dispensing arrangement can be part of one or more of the apparatuses described above, can be used for the widest range of refrigeration appliances as described above and can also be referred to as an ice dispenser. In particular the ice dispensing arrangement serves to open and close a pivotable flap of an ice crusher. The energy required for opening and closing the flap is supplied by a motor, which is in particular an electric motor, with any type of suitable motor being conceivable.

The motor and flap are coupled to one another by way of a transfer device so that rotation of a shaft of the motor brings about movement of the flap. The flap can be moved between the first dispensing position and the second dispensing position. Position in this context can also refer to a position region, in other words the first and second dispensing positions can comprise a number of flap positions. In the first dispensing position the flap of the ice crusher is preferably positioned in such a manner that ice cubes can be crushed in the first dispensing position. The flap does not close the ice crusher off completely here, so that the crushed ice cubes can drop out of the ice crusher. When the flap is in the second dispensing position the ice crusher is preferably further open, so that whole ice cubes can drop through the ice crusher without being crushed. The flap can preferably be pivoted about a pivot axis.

The transfer device comprises the rotating transfer element, so that the flap and motor can be separated spatially. The rotating transfer element can be rotated at least between the first position and the second position, with the energy required for this purpose preferably being supplied by the motor. The first and second positions can also refer to a first position region and a second position region, with in particular the first and second positions or the first and second position regions covering an angle region.

One end of the rotating transfer element, which is arranged in proximity to the flap, can preferably be provided with the flap actuation device, which can be configured as a crank or lever arm. The flap actuation device can be configured as a single piece with the rotating transfer element. All possible types of fastening can be used to attach the flap actuation device to the rotating transfer element, with a single-piece embodiment of the flap actuation device and the rotating transfer element being preferred. Alternatively the flap actuation device can be fastened by screwing, bonding or welding.

The rotating transfer element is coupled to the flap actuation device in such a manner that rotation of the rotating transfer element results in pivoting of the flap. In particular the flap is closed when the rotating transfer element is in the first position and the flap is open when the rotating transfer element is in the second position. When the rotating transfer element is rotating from the first position to the second position, the flap is preferably moved from the first dispensing position to the second dispensing position. Rotation of the rotating transfer element from the second position to the first position can preferably bring about the pivoting of the flap from the second dispensing position to the first dispensing position.

The blocking device holds the flap in the first dispensing position. This can also include locking, closing or blocking the flap. This allows the flap actuation device to be used to open the flap while the blocking device locks the flap. Permanent locking of the flap is of particular importance when the pivotable flap is a flap of an ice crusher, as large forces act on the flap when ice is crushed. The blocking device is preferably coupled to the rotating transfer device so that rotation of the rotating transfer device brings about movement of the blocking device. The blocking device can be a bolt for example, which is positioned in proximity to the flap and is moved by the rotating transfer device.

The flap, the blocking device and the rotating transfer element can be made from a plastic or metal. However other materials are also conceivable, which have the mechanical properties required for the use of said parts.

It is preferable for the blocking device to be able to be pivoted between a blocking position for holding the flap in the first dispensing position and a release position.

When the blocking device is in the blocking position the blocking device blocks, holds or locks the flap. The flap can therefore no longer open. In the release position the blocking device is pivoted away from the blocking position so that pivoting of the flap is no longer impeded and the flap can be opened by means of the flap actuation device.

It is preferable for the blocking device, the rotating transfer element and/or the flap actuation device to be able to be pivoted about a common rotation axis, which is preferably essentially parallel to the pivot axis of the flap.

The common rotation axis is preferably a rotation axis of the rotating transfer element. This represents a simple embodiment. If the pivot axis of the flap and the rotation axis of the rotating transfer element are parallel to one another, the motor can be arranged in front of or behind the flap, for example behind the ice maker and/or the ice crusher. This allows a variable arrangement of the individual components so that space in a refrigeration appliance can be utilized particularly efficiently.

It is further preferable for the blocking device to be positioned on the flap actuation device and/or on the rotating transfer element.

This allows easy pivoting of the blocking device to be achieved, with the blocking device and the flap actuation device rotating synchronously. This in particular ensures that the flap can only be opened when it is not locked. The blocking device can be configured as a single piece with the flap actuation device. In particular the blocking device is fastened to the flap actuation device, in particular by means of a snap fastening or a clamping apparatus. The blocking device rotates with the flap actuation device. The blocking device can be positioned on the rotating transfer element in a similar manner. The blocking device can thus also be fastened both to the flap actuation device and to the rotating transfer element.

If the blocking device is positioned in proximity to the rotating transfer element or more specifically in proximity to the rotation axis of the rotating transfer element, a smaller torque acts on the rotating transfer element when the flap is unlocked than when the blocking device is positioned further away from the rotation axis of the rotating transfer element on the flap actuation device. This allows a greater holding force to be exerted on the flap while the torque on the rotating transfer element in the first position remains the same, as greater friction forces can act in the blocking device due to the smaller lever. Therefore greater forces can act on the flap in the ice crusher.

It is also preferable for a projection to be arranged on the flap and for the blocking device to have a stop to hold the flap in the first dispensing position, the stop only blocking the projection in the first position to hold the flap in the first dispensing position.

Arranged on the flap is a projection, which can be configured as a single piece with the flap or can be fastened to the flap. A very wide range of options is conceivable for fastening the projection to the flap, in particular for example bonding, screwing, welding or the like. In the first position the projection and blocking device preferably engage in one another, thereby locking or holding the flap.

The stop of the blocking device preferably engages behind the projection of the flap. This represents a secure and simple blocking device. The shape of the stop is preferably matched to the shape of the projection and in particular the projection engages behind the stop with a form fit.

It is preferable for the flap or the projection to have a receiving region, which is delimited by a peripheral edge that protrudes from the receiving region. It is also preferable for the flap actuation device to have an arm, which projects into the receiving region.

The flap is therefore pivoted into the second dispensing position by the flap actuation device when the rotating transfer element rotates about its rotation axis. To this end the flap has a receiving region, which is delimited by a peripheral edge. The peripheral edge protrudes from the receiving region in such a manner that, when the flap actuation device moves, the flap actuation device moves against the peripheral edge. In particular the receiving region can be a surface that protrudes from the peripheral edge preferably in a perpendicular manner. However the receiving region can also be a hollow space delimited by the peripheral edge. The peripheral edge then also protrudes from the receiving region. An arm of the flap actuation device projects into the receiving region. The arm is preferably bent and part of the arm is parallel to the rotation axis of the rotating transfer element.

The opening of the flap is thus advantageously separated functionally from the locking of the flap by means of the blocking device. As the arm is preferably further away from the rotation axis of the rotating transfer element than the blocking device, the arm passes through a longer curve region so the arm can open the flap wide. In comparison when moving the flap actuation device the blocking device passes through a shorter curve region so if it were to open the flap, the blocking device would not be able to open the flap as far. Conversely the arm can apply a smaller force than the blocking device for the same motor power, as the arm is further away from the rotation axis of the rotating transfer element than the blocking device. A greater force is therefore generally required to unlock the flap and therefore also to block it than to open the flap. The requirements for unlocking and opening the flap are advantageously achieved in a simple manner by the functional separation by means of the arm and the blocking device.

Closing of the flap can be achieved either by means of the flap actuation device, in particular by means of the arm, or even by means of a spring, which pushes the flap into the first dispensing position, which corresponds to the first position of the rotating transfer element. Locking then takes place by means of the blocking device.

It is preferable for the arm not to touch the peripheral edge when the rotating transfer element is positioned in the first position and preferably for the arm to push against the peripheral edge when the rotating transfer element is positioned in the second position.

In the first position, in other words when the flap is in the first dispensing position, the arm does not touch the edge region. If a force now acts on the flap, the arm cannot become jammed with the peripheral edge of the flap, so the opening of the flap is less likely to be blocked. This can occur in particular in the prior art where the flap is opened and locked by means of the flap actuation device so that when locked the flap actuation device and the flap often become jammed, thereby blocking the opening of the flap. The distance between the peripheral edge and the arm is preferably selected such that the occurrence of jamming is minimized but the distance is not too great so that there is no reduction of the opening angle of the flap achieved by the flap actuation device. The flap is opened when the arm of the flap actuation device pushes against the peripheral edge. The second position is therefore the region in which the flap is opened or closed.

It is further preferable for the rotating transfer element and the flap actuation device each to be configured as a bar arrangement and/or for the rotating transfer element and the flap actuation device to be configured as a single piece.

This represents an embodiment of the rotating transfer element and the flap actuation device that is particularly easy to manufacture. This allows production costs to be reduced.

It is preferable for the rotating transfer element and/or the arm to extend essentially parallel to the pivot axis of the flap. It is further preferable for the flap actuation device to extend essentially radially to the pivot axis of the flap and/or in an essentially perpendicular manner from the rotating transfer element.

It is preferable for the motor to have a shaft, with the transfer device also having a hub connected to the shaft of the motor and at least one connecting rod, the rotating transfer element being able to be rotated between the first position and the second position in such a manner that the flap is in the first dispensing position when the rotating transfer element is in the first position and the flap is in the second dispensing position when the rotating transfer element is in the second position, the rotating transfer element being provided with a coupling element and the at least one connecting rod coupling a point on the hub which is away from the center of the shaft of the motor to the coupling element of the rotating transfer element in such a manner that the rotating transfer element can be rotated between the first position and the second position.

The transfer device can also comprise a crank drive or be referred to as such due to the configuration with at least one connecting rod.

One end of the rotating transfer element which is arranged in proximity to the motor can preferably be coupled to the hub by way of the at least one connecting rod. The hub is preferably fastened to the shaft of the motor in a rotationally fixed manner. The rotation of the hub is preferably converted to a periodic movement of the coupling element by means of the connecting rod. The highest point and lowest point of the periodic movement correspond to the first and second positions. The periodic movement can be a movement with a direction component in the vertical direction and/or a movement with a direction component in the horizontal direction.

It is preferable for the coupling element to have an offset. The offset can also be referred to as a bend.

It is further preferable for the offset to comprise a connecting segment and an offset segment, the connecting segment connecting the offset segment to the rotating transfer element and the offset segment coupling the rotating transfer element to the at least one connecting rod for operating purposes.

It is preferable for the connecting segment to run at an angle, preferably obliquely, to a longitudinal axis of the rotating transfer element and for the offset segment to run with a parallel offset at least in segments to the longitudinal axis of the rotating transfer element. The connecting segment and the offset segment and/or the connecting segment and the rotating transfer element can be embodied as a single part.

It is also preferable for the at least one connecting rod to be coupled in a pivotable and/or displaceable manner to the coupling element, in particular to the offset segment.

The offset or bend is connected to the rotating transfer element by way of the connecting segment. The offset, the connecting segment and the rotating transfer element are preferably configured as a single piece and made for example from a metal or plastic. The connecting rod can preferably rotate at least partially about the offset. This allows an up and down movement of the connecting rod to bring about a periodic movement of the offset, which in turn results in a rotation of the rotating transfer element. Rotation of the rotating transfer element takes place between the first position and the second position.

The shaft of the motor is preferably fastened at a center point of the hub. The point at which the connecting rod is attached to the hub is preferably offset in relation to the center point and therefore away from the center. Connecting rod and hub can be made from plastic or metal.

It is preferable for the transfer device to have just one connecting rod which is coupled to the offset segment for operating purposes.

The connecting rod is preferably coupled in a fixed position and in a pivotable manner to the offset segment or the coupling element. A fixed position here means in particular that the offset segment cannot move in relation to the connecting rod. Pivotable preferably means that the connecting rod can be pivoted in relation to the offset or the offset segment. This allows the transfer device to be actively rotated from the first position to the second position and from the second position to the first position, in order words force can be applied to the transfer device. This in turn means that force can be applied to the flap to open and close it or in other words to pivot it from the first dispensing position to the second dispensing position and vice versa. The connecting rod is preferably fastened to the hub in such a manner that a 180° rotation of the motor shaft rotates the transfer device from the first position to the second position and a further 180° rotation of the motor shaft rotates the transfer device from the second position to the first position. In other words during one revolution of the motor shaft the flap is moved from the first dispensing position to the second dispensing position and back again. Alternatively the motor can be a bidirectional motor so that the opening of the flap, the rotation of the transfer device from the first position to the second position, is achieved by rotating the motor in the one direction, while the closing of the flap, the rotation of the transfer device from the second position to the first position, is achieved by rotating the motor shaft in the counter direction.

It is alternatively preferable for the transfer device to have two or more connecting rods, each connecting rod having an opening (also referred to as the transfer opening), into which the offset segment projects and which is greater than the cross-sectional surface of the offset segment.

If there are two connecting rods, the transfer device is preferably rotated from the first position to the second position by a 90° rotation of the motor shaft. A further 90° rotation of the motor shaft preferably rotates the transfer device from the second position to the first position, if two connecting rods are provided. In other words during one revolution of the motor shaft the flap is moved twice from the first dispensing position to the second dispensing position and back again. This allows fast activation of the flap to be achieved.

It is further preferable for the at least one connecting rod in each instance to have a guide opening, in which a guide element for guiding the movement of the at least one connecting rod engages.

The guide element is arranged in a fixed position relative to the motor so that the connecting rod and guide element can move in relation to one another. The guide element is preferably an axis or extends along an axis which passes through the connecting rod. This arrangement allows the offset to be displaced from the first position to the second position in relation to the rotation axis of the rotating transfer element and when the motor shaft is rotated further in the same direction, the contact between the offset and the connecting rods is canceled so the rotating transfer element can rotate back into the first position. However no force is provided by the connecting rods to rotate the rotating transfer element from the second position to the first position, so a spring is preferably used for the purpose. This described arrangement has the advantage that the flap can be opened a number of times during one revolution of the motor.

It is preferable for the rotating transfer element and the coupling element to be configured as a single piece and/or for the rotating transfer element and the coupling element each to be configured as a bar element.

This represents a particularly simple embodiment of the transfer device allowing costs to be saved during manufacture.

The invention also provides a refrigeration appliance, in particular a household refrigeration appliance, which comprises an ice dispensing arrangement as described above. The refrigeration appliance therefore has an ice dispensing arrangement with the features and advantages described above. The refrigeration appliance, in particular the household refrigeration appliance, can also comprise an ice crusher (apparatus for crushing ice cubes) and/or an ice maker (apparatus for making ice cubes).

To summarize and as an alternative a preferred embodiment of the invention is described again below.

The use of a crank drive as part of the transfer device with a crank means that the flap can be forced to move by the motor both in the opening direction and in the closing direction. This crank drive can preferably be connected to the flap by means of a rotating transfer element in the form of a connecting bar, said connecting bar preferably being bent at both ends. The crank drive can be generated by means of one or more connecting rods. The use of a number of connecting rods has the advantage inter alia that the flap can be opened and closed in a short time when the motor is running slowly.

A further improvement has also been brought about on the flap side. As set out above, the connecting bar has an offset (or bend) both on the crank side and on the flap side, in order to be able to actuate the flap. On the flap side the offset can be used to block the flap for the crushing of ice and, when the crank drive is activated, to open the flap by means of a lever. When the flap is open, the ice cubes are all dispensed without being crushed. During crushing however it can come about that the ice cubes become jammed in the crusher housing and exert a large force on the flap. The large friction force now resulting between the connecting bar and the flap means that the motor requires a high power to open the flap. The offset can preferably have a certain length so that the flap can be opened wide enough with the crank drive. The possible separation of the functions—blocking and opening—means that the flap can be reliably unlocked and at the same time opened wide enough by means of a less powerful motor. The blocking edge for the flap is in proximity to the rotation point of the connecting bar and therefore more force is supplied by the lever drive to unlock the flap. The long lever arm can only be used to open the flap. It is also an advantage of the invention described here compared with the magnet solution cited in the introduction, in which the flap is opened jerkily, that the ice cubes are dispensed slowly out of the ice storage container. The use of a crank drive with a crank in particular means that the flap can be forced to move by the motor both in the opening direction and in the closing direction. The crank drive is connected to the flap by means of the connecting bar, which is bent at both ends. This ensures reliable opening and closing of the flap. The separation of the functions—blocking and opening—means that the flap can be reliably unlocked and at the same time opened wide enough by means of a less powerful motor.

BRIEF DESCRIPTION OF THE SEVERAL VIEWS OF THE DRAWING

Embodiments and advantages of the invention are set out below with reference to the exemplary embodiment illustrated in the figures, in which.

DESCRIPTION OF THE INVENTION

Figure 1:
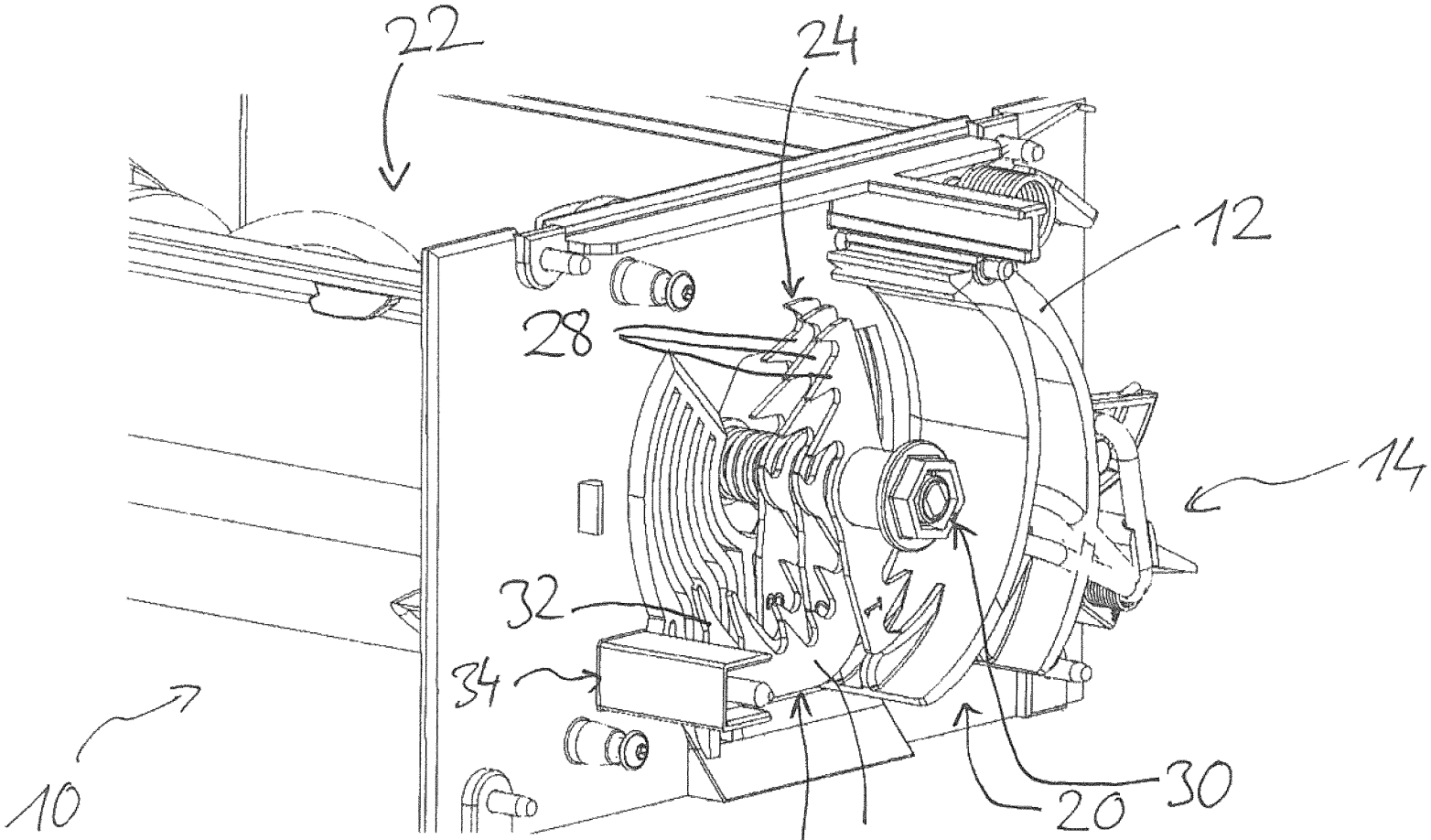
FIG. 1 shows a perspective view of an ice dispensing arrangement in three positions.
Figure 2:
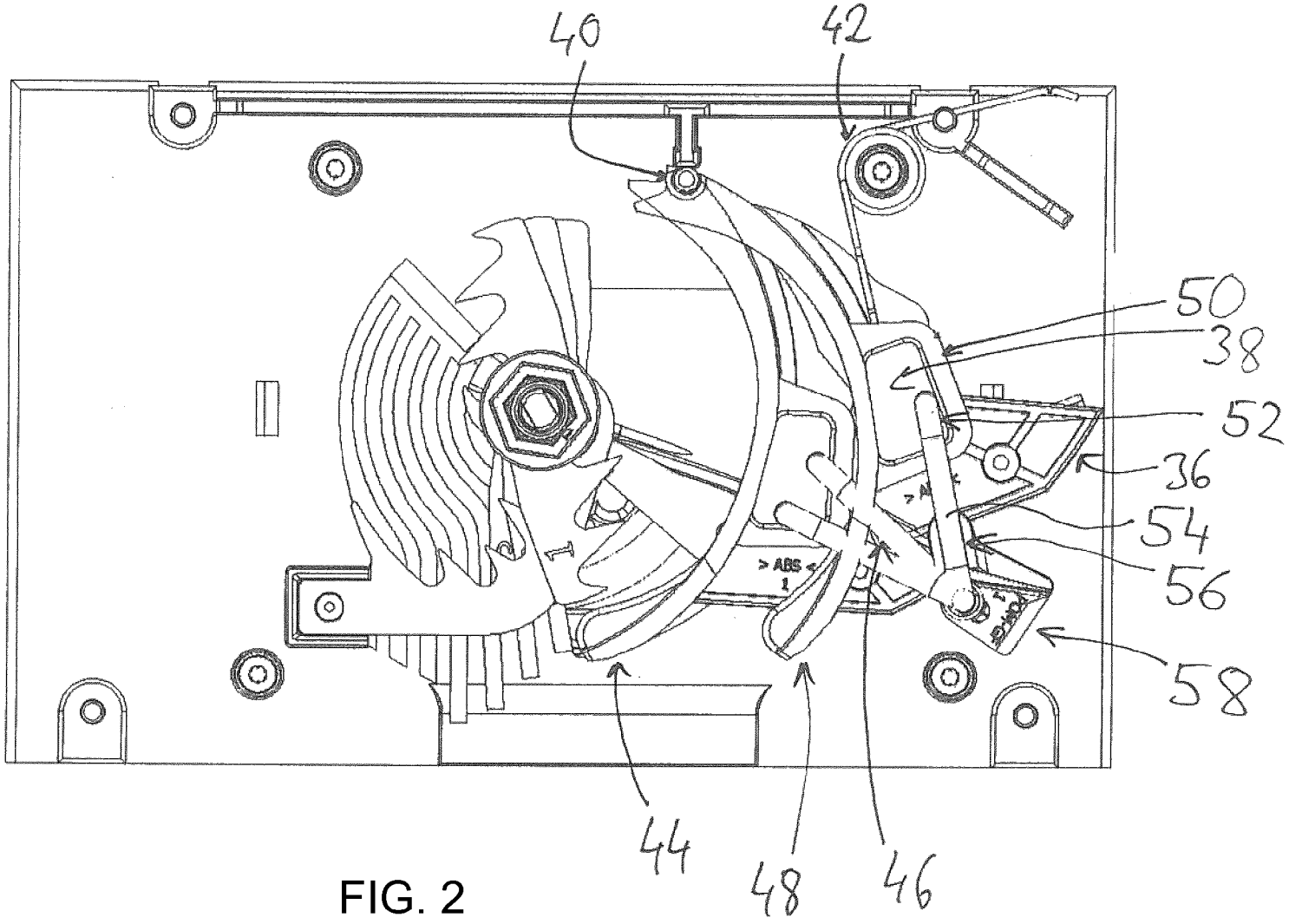
FIG. 2 shows a plan view of the ice dispensing arrangement in three positions.
Figure 3:
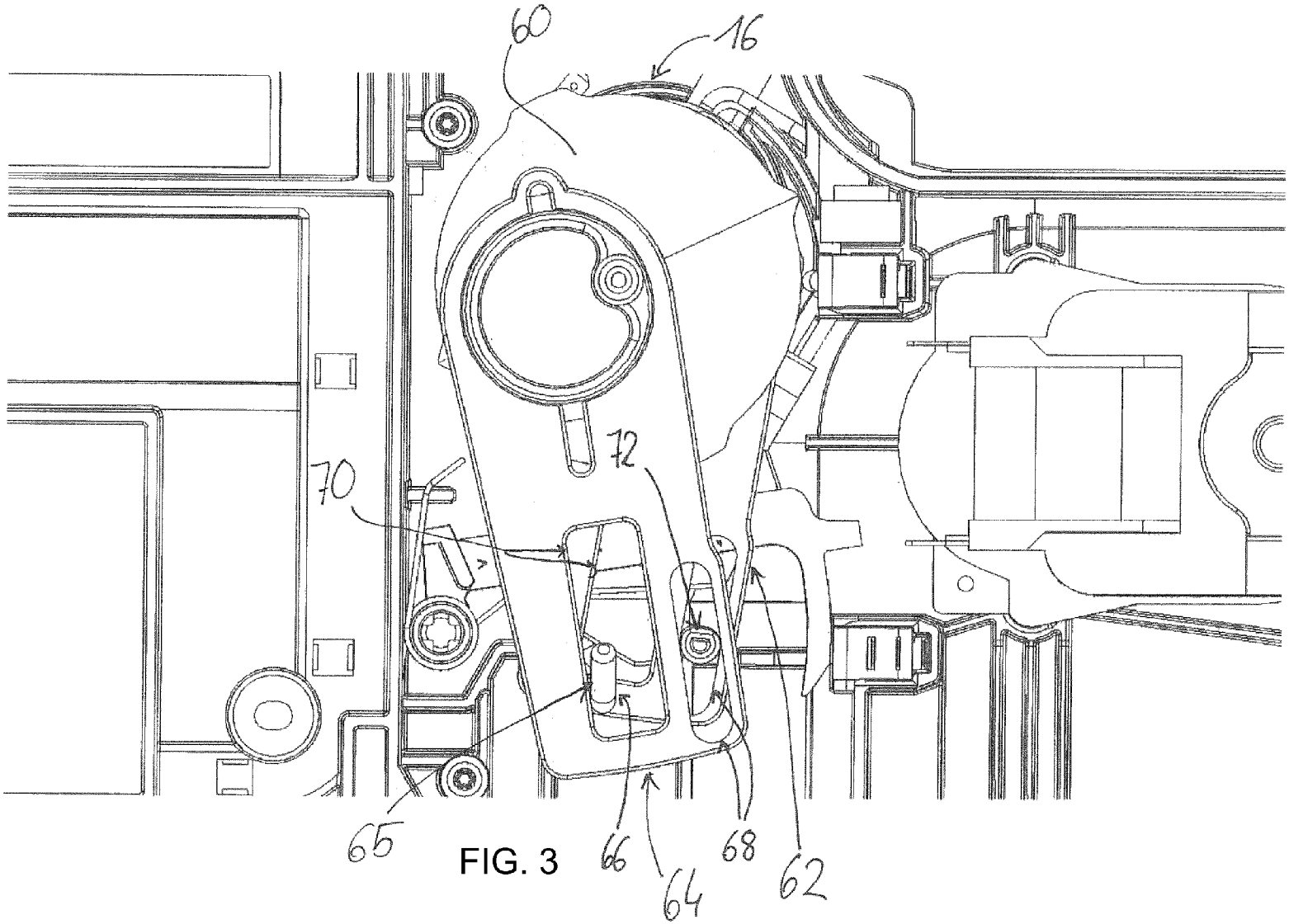
FIG. 3 shows a plan view of the ice dispensing arrangement from the motor side.
Figure 4:
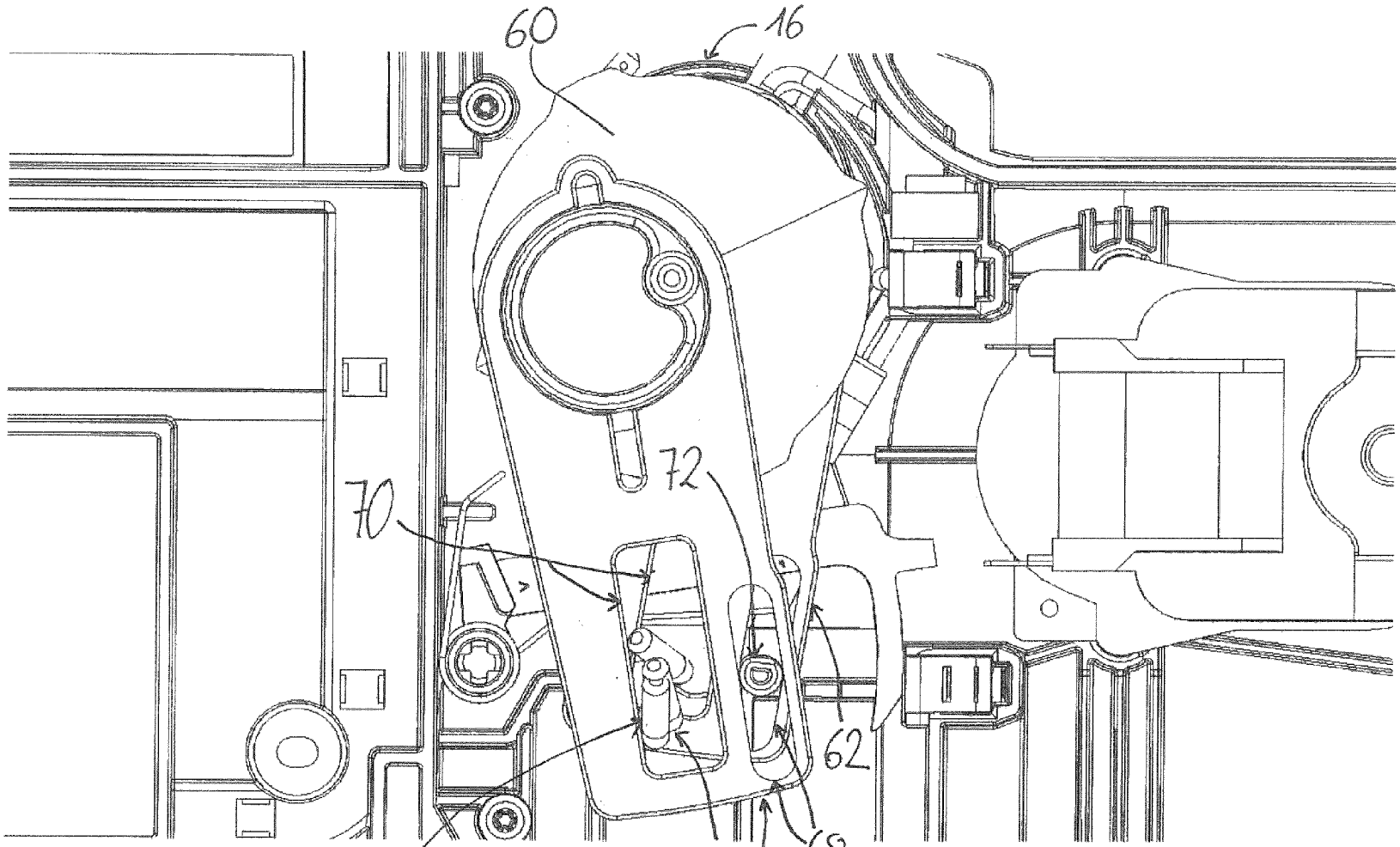
FIG. 4 shows a plan view of the ice dispensing arrangement in three positions from the motor side.
Figure 5:
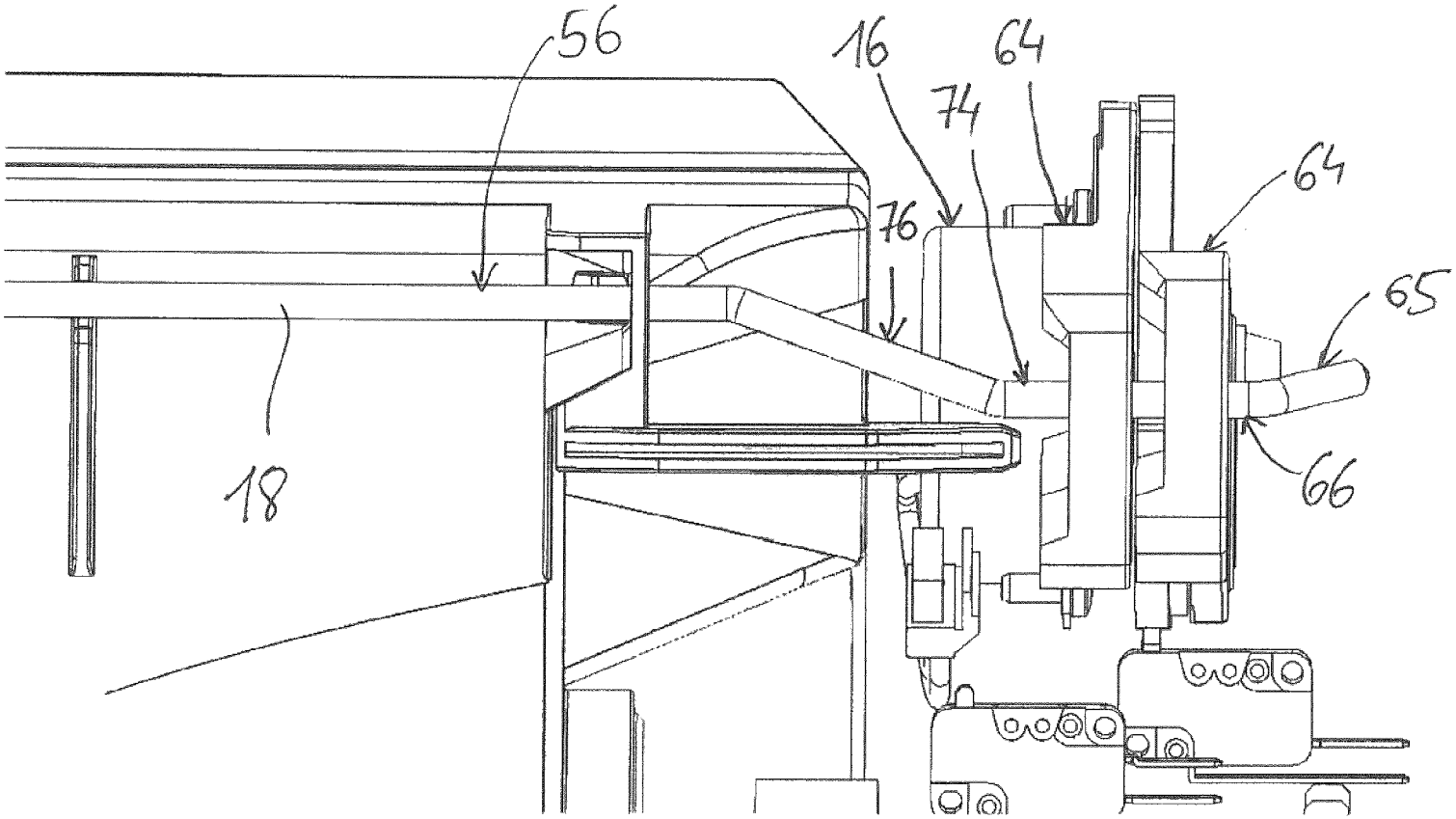
FIG. 5 shows a plan view from below of the ice dispensing arrangement on the motor side.
Figure 6:
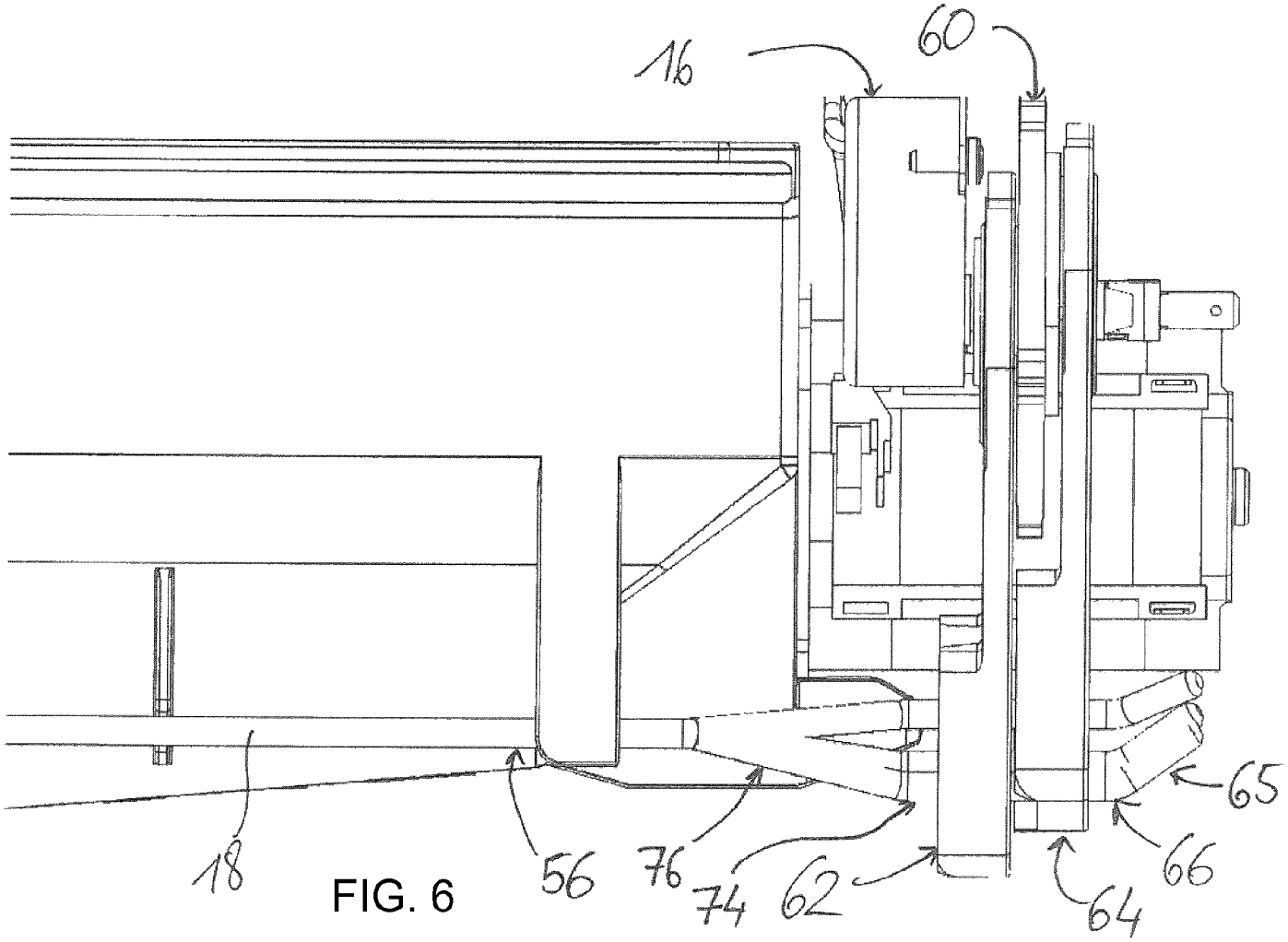
FIG. 6 shows a plan view from below of the ice dispensing arrangement in three positions from the motor side.

An ice dispensing arrangement 10 has a flap 12, a motor 16 and a transfer device 14. FIGS. 1 and 2 show the flap-side part of the transfer device 14. FIGS. 3 to 6 show the motor 16 and the motor-side part of the transfer device 14. The transfer device 14 has a bar element 18, which is shown in FIGS. 5 and 6, which connects the motor-side part of the transfer device 14 to the flap-side part of the transfer device 14. The motor 16 drives the transfer device 14 so that the bar element 18 rotates about its rotation axis between a first position and a second position. The rotation of the bar element 18 causes the flap 12 to pivot.

The flap side of the ice dispensing arrangement 10 will first be described with reference to FIGS. 1 and 2. The flap 12 of the ice dispensing arrangement 10 is a flap 12 of an ice crusher 20, which can be pivoted between a first dispensing position 44 and a second dispensing position 48. The ice crusher 20 is arranged on an ice dispenser 22. The ice dispenser 22 can have an ice maker. The ice crusher 20 has a fixed housing part (not shown) and the flap 12, which form a housing of the ice crusher 20. Arranged in the housing are a movable blade set 24 and a fixed blade set 26. The movable blade set 24 preferably has three movable blades 28, which are fastened to a rotating shaft 30 of the ice crusher 20. The rotation of the rotating shaft 30 by means of a motor (not shown) causes the movable blades 28 to move toward the fixed blade set 26. Ice cubes supplied by the ice dispenser 22 are crushed between the fixed blade set 26 and the movable blade set 24. The fixed blade set 26 preferably has two fixed blades 32, which are fastened to a holding device 34 of the ice crusher. The fixed blades 32 are not movable.

The flap 12 has a projection 36 and a receiving region 38. The flap 12 is supported in such a manner that it can be pivoted about a pivot axis 40 and is pushed into a first dispensing position 44 by way of a spring 42. In the first dispensing position 44 the ice crusher 20 is closed to such a degree that ice cubes can be crushed in the ice crusher 20. However crushed ice cubes can drop out of the ice crusher 20 in the first dispensing position 44. In an alternative embodiment the spring 42 can be dispensed with and the opening and closing of the flap 12 can be brought about by means of the flap actuation device.

In the first dispensing position 44 the projection 36 protrudes from the flap 12 in the direction of the bar element 18. The flap 12 can be pivoted into a second dispensing position 48 by way of a transition position 46. The first dispensing position 44 can be a region, while the transition position 46 separates the first dispensing position 44 from the second dispensing position 48, which can also be a region. The abovementioned region refers in particular to an angle region.

The receiving region 38 is delimited by the peripheral edge 50. The peripheral edge 50 protrudes from the receiving region 38. The height of the peripheral edge 50, in other words the length of the protrusion of the peripheral edge 50 in relation to the receiving region 38, is such that an arm 52 of a flap actuation device 54 of the bar element 18 can transfer force to open and/or close the flap 12.

The bar element 18, the flap actuation device 54 and the arm 52 form part of a rotating transfer element 56. The bar element 18 can be a hollow or solid bar. In the embodiment shown the bar element 18, the flap actuation device 54 and the arm 52 are made as a single piece from a material such as plastic or metal for example. The arm 52 can be configured as essentially L-shaped, C-shaped, straight or bent in parts.

A blocking device 58 is fastened to the flap actuation device 54. The blocking device 58 has a stop (not shown) and abuts around the bar element 18. The blocking device 58 is fastened to the flap actuation device 54 for example by way of a clamping mechanism. When the flap 12 is in the first dispensing position 44 the stop of the blocking device 58 engages behind an end region, preferably a pointed end, of the projection 36. The rotating transfer element 56 or the bar element 18 is in a first position here. If the stop and projection 36 do not engage, as for example when the flap 12 is in the second dispensing position 48, the rotating transfer element 56 or the bar element 18 is in a second position. The position of the blocking device 58, in which the stop and the projection 36 engage, is referred to as the blocking position and correlates with the first dispensing position 44 of the flap 12 and the first position of the rotating transfer element. The position of the blocking device 58, in which the stop and the projection 36 do not engage, is referred to as the release position and correlates with the second dispensing position 48 of the flap 12 and the second position of the rotating transfer element.

The pivot axis 40 of the flap 12 is parallel to the rotation axis of the rotating transfer element 56. Also the part of the arm 52, which projects into the receiving region 38, is parallel to the pivot axis 40 and the rotation axis of the rotating transfer element 56. The blocking device 58, the arm 52 and the flap actuation device 54 can be pivoted about the rotation axis of the rotating transfer element 56.

The mode of operation for opening the flap 12 is described below.

In the first dispensing position 44 the bar element 18 is in the first position and the blocking device 58 engages behind or blocks the projection 36 in the blocking position. As a result the flap 12 is blocked by the blocking device 58, while the arm 52 of the flap actuation device 54 does not touch the peripheral edge 50. If the bar element 18 is now moved in the direction of the second position, the transition position 46 results at one time point. In the transition position 46 the blocking device 58 no longer engages behind or blocks the projection 36 and the blocking device 58 is in the release position. The arm 52 of the flap actuation device 54 now touches the peripheral edge 50 of the receiving region 38. If the bar element 18 is moved further in the direction of the second position, the arm 52 of the flap actuation device 54 pushes against the peripheral edge 50 of the receiving region 38 and the flap 12 is opened counter to the pretension of the spring 42 until the flap 12 reaches the second dispensing position 48. The arm 52 of the flap actuation device 54 engages with the flap 12 further away from the rotation axis of the bar element 18 than the blocking device 58. Therefore the arm 52 causes a smaller force to act on the flap 12 for the same torque on the bar element 18 than the blocking device 58. Therefore for the same torque on the bar element 18 a greater unlocking force for unlocking the flap 12 is achieved as the opening force. Greater forces can therefore act on the flap 12 in the ice crusher 20.

As the bar element 18 rotates from the second position to the first position the flap 12 is moved into the first dispensing position 44 by means of the pretension of the spring 42. The blocking device 58 now engages behind or blocks the projection 36 again and the flap 12 is locked (blocking position of blocking device 58).

The motor-side part of the transfer device 14 is now described below.

On the motor side the transfer device 14 has a hub 60, a first connecting rod 62 and a second connecting rod 64. The transfer device 14 also has a coupling element 65 on the motor-side end of the bar element 18, which corresponds to the second end, said coupling element 65 being or comprising an offset 65 in the embodiment shown.

The hub 60 is fixed centrally on a shaft (not shown) of the motor 16. The first connecting rod 62 is arranged in closer proximity to the motor 16 on one side of the hub 60, while the second connecting rod 64 is arranged further away from the motor 16 on the other side of the hub 60. Both connecting rods 62, 64 are fastened to the motor shaft away from the center in a pivotable manner. During a rotation of the motor shaft and an associated rotation of the hub 60 the connecting rods 62 and 64 are moved up and down. The connecting rods 62, 64 also have a guide opening 68 and an opening or transfer opening 70. A guide element 72 in the form of a guide axis is arranged in both guide openings 68. The guide openings 68 have a longer length than width, the width of the guide openings 68 corresponding to a diameter of the guide element 72. As the connecting rods 62, 64 move up and down, the guide opening 68 travels along the guide element 72. The offset 66 of the bar element 18 projects into the two transfer openings 70 of the connecting rods 62, 64. In particular an offset segment 74 of the offset 66 is positioned in the two transfer openings 70 of the connecting rods 62, 64 or projects therein. The transfer opening 70 is larger than the guide opening 72.

As shown particularly clearly in FIGS. 5 and 6, the offset 66 comprises the offset segment 74 and a connecting segment 76. The connecting segment 76 is angled toward the bar element 18 and the offset segment 74 and connects them. A longitudinal axis of the offset segment 74 is offset parallel to the rotation axis of the bar element 18. The bar element 18 is supported in a rotatable manner.

The mode of operation of the motor-side transfer device 14 is now described below.

During actuation of the motor 16 the shaft of the motor 16 is rotated and therefore also the hub 60. The non-central positioning of the connecting rods 62, 64 means that they are moved up and down. The guide element 72 causes the offset 66 to be deflected to the side in relation to the rotation axis of the bar 18. In FIG. 4 the offset, or more specifically the offset segment 74, is deflected to the right. Deflection is only brought about by one of the connecting rods 62, 64. If the hub 60 or motor shaft is rotated further, the connecting rods 62, 64 are positioned in such a manner that they do not bring about any deflection of the offset 66. The pretension of the spring 62 means that the flap 12 is pushed back into its first dispensing position and the offset 66 can move back into the first position shown in FIG. 3. If the hub 60 rotates still further, the offset 66 is deflected by the other of the connecting rods 62, 64. If the hub 60 is rotated further again in the same direction, the offset 66 loses contact with the other of the connecting rods 62, 64 and the connecting rod 62, 64 moves back into the first position shown in FIG. 3.

LIST OF REFERENCE CHARACTERS

10 Ice dispensing arrangement
12 Flap
14 Transfer device
16 Motor
18 Bar element
20 Ice crusher
22 Ice dispenser
24 Movable blade set
26 Fixed blade set
28 Movable blade
32 Fixed blade
34 Fastening device
36 Projection
38 Receiving region
40 Pivot axis
42 Spring
44 First dispensing position
46 Transition position
48 Second dispensing position
50 Peripheral edge
52 Arm
54 Flap actuation device
56 Rotating transfer element
58 Blocking device
60 Hub
62 First connecting rod
64 Second connecting rod
65 Coupling element
66 Offset
68 Guide opening
70 Transfer opening
72 Guide element
74 Offset segment
76 Connecting segment

The invention claimed is:

1. An ice dispensing arrangement, comprising:

a flap pivotally mounted between a first dispensing position and a second dispensing position;

a transfer device having a rotating transfer element and a flap actuation device;

said rotating transfer element of said transfer device being rotatably mounted between a first position and a second position for pivoting said flap between the first dispensing position and the second dispensing position by way of said flap actuation device;

said rotating transfer element of said transfer device being coupled to said flap actuation device such that said flap is in the first dispensing position when said rotating transfer element is in the first position and said flap is in the second dispensing position when said rotating transfer element is in the second position;

a blocking device configured to hold said flap in the first dispensing position; and a motor configured to actuate said flap by way of said transfer device; said motor having a shaft and said transfer device having a hub connected to said shaft of said motor and at least one connecting rod;

said rotating transfer element being rotatably mounted between the first position and the second position such that said flap is in the first dispensing position when said rotating transfer element is in the first position and said flap is in the second dispensing position when said rotating transfer element is in the second position;

said rotating transfer element including a coupling element; and said at least one connecting rod being disposed to couple a point on said hub excentrically distal from a center of said shaft of said motor to said coupling element of said rotating transfer element to enable a rotation of said rotating transfer element between the first position and the second position.

2. The ice dispensing arrangement according to claim 1 configured for a household refrigeration appliance.

3. The ice dispensing arrangement according to claim 1, wherein said blocking device is mounted for pivoting between a blocking position, for holding said flap in the first dispensing position, and a release position.

4. The ice dispensing arrangement according to claim 1, wherein said blocking device, said rotating transfer element, and said flap actuation device are pivotally mounted about a common rotation axis.

5. The ice dispensing arrangement according to claim 4, wherein said common rotation axis is substantially parallel to a pivot axis of said flap.

6. The ice dispensing arrangement according to claim 1, wherein said blocking device is disposed on one or both of said flap actuation device and said rotating transfer element.

7. The ice dispensing arrangement according to claim 1, wherein said flap is formed with a projection and said blocking device has a stop to hold the flap in the first dispensing position, and wherein said stop only blocks said projection in the first position to hold said flap in the first dispensing position.

8. The ice dispensing arrangement according to claim 1, wherein said flap or said projection has a receiving region, which is delimited by a peripheral edge that protrudes from said receiving region, and said flap actuation device has an arm, which projects into said receiving region.

9. The ice dispensing arrangement according to claim 8, wherein said arm does not touch said peripheral edge when said rotating transfer element is positioned in the first position and said arm pushes against said peripheral edge when said rotating transfer element is positioned in the second position.

10. The ice dispensing arrangement according to claim 1, wherein each of said rotating transfer element and said flap actuation device is a rod element and/or each of said rotating transfer element and said flap actuation device is configured in a single piece.

11. The ice dispensing arrangement according to claim 1, wherein said rotating transfer element extends substantially parallel to a pivot axis of said flap and said flap actuation device extends substantially radially to the pivot axis of said flap and/or substantially perpendicular from said rotating transfer element.

12. A refrigeration appliance, comprising an ice dispensing arrangement according to claim 1.

13. A household refrigerator, comprising ice dispensing arrangement according to claim 1.

* * * * *